US006988699B2

(12) United States Patent
Hsu

(10) Patent No.: US 6,988,699 B2
(45) Date of Patent: Jan. 24, 2006

(54) SHEET MEMBER HOLDER

(76) Inventor: Hua Wen Hsu, 3F, 20, Alley 1, Lane 768, Sec. 4, Pa Te Road, Taipei (TW)

( * ) Notice: Subject to any disclaimer, the term of this patent is extended or adjusted under 35 U.S.C. 154(b) by 72 days.

(21) Appl. No.: 10/820,945

(22) Filed: Apr. 7, 2004

(65) Prior Publication Data

US 2005/0224681 A1 Oct. 13, 2005

(51) Int. Cl.
*A47B 97/04* (2006.01)

(52) U.S. Cl. ..... 248/450; 248/441.1; 40/124.07; 40/649; 40/658; 446/267

(58) Field of Classification Search ..... 248/441.1, 248/450, 469, 473; 40/124.07, 658, 649, 40/650, 738, 761; 446/267; D19/35, 36, D19/65, 75, 78, 86–91, 95–100; D6/300, D6/302, 310
See application file for complete search history.

(56) References Cited

U.S. PATENT DOCUMENTS

| | | | | | |
|---|---|---|---|---|---|
| D101,143 | S | * | 9/1936 | Shank | D6/310 |
| D388,464 | S | * | 12/1997 | Najbart | D19/78 |
| 5,911,398 | A | * | 6/1999 | VanLandingham, Jr. | 248/441.1 |
| 6,165,041 | A | * | 12/2000 | Lin | 446/267 |
| 6,412,743 | B1 | * | 7/2002 | Fell | 248/441.1 |
| 6,578,811 | B1 | * | 6/2003 | Suzuki | 248/451 |
| 6,645,580 | B1 | * | 11/2003 | Tsai | 428/11 |
| 6,792,709 | B1 | * | 9/2004 | Fine et al. | 40/720 |
| 6,808,152 | B2 | * | 10/2004 | Fell | 248/441.1 |

* cited by examiner

*Primary Examiner*—Korie Chan
(74) *Attorney, Agent, or Firm*—Pro-Techtor Int'l Services

(57) ABSTRACT

A sheet member holder includes a holder base with a smoothly arched upright at the border, a dome-like cover member holding a fluid and a floating ornament on the fluid and covered on the holder base, and a smoothly arched retaining gap defined in between the dome-like cover member and the smoothly arched upright for holding a sheet member in a vertical position.

7 Claims, 4 Drawing Sheets

SHEET MEMBER HOLDER

BACKGROUND OF THE INVENTION

1. Field of the Invention

The present invention relates a sheet member holder for holding a sheet member in a vertical position and more particularly, to such a sheet member holder, which holds a floating ornament on a fluid inside the cover shell thereof.

2. Description of the Related Art

Various holder devices for hold a sign or page in a vertical position are known. Exemplars are seen in U.S. Pat. Nos. 6,059,249; D418,166; 6,267,346B1; 5,857,654; 5,911,398; D388,464; D342,096; U.S. Pat. Nos. D478,353 4,125,243; D101,143; 1,609,700; 1,152,461; 1,681,586; 3,272,183; 4,685,647. These designs commonly provide a groove in the shell for holding a sign or page in a vertical position. However, because the groove has a certain depth and is provided on the middle or near the front side of the shell, the inserted sign or page blocks a big part of the shell from the user's sight, i.e., the printing on the shell cannot be seen clearly after insertion of a sign or page into the groove.

SUMMARY OF THE INVENTION

The present invention has been accomplished under the circumstances in view. According to one aspect of the present invention, the sheet member holder comprises a holder base, which comprises a carrier and a smoothly arched upright upwardly extended from the top side of the carrier at one side, and a dome-like cover member mounted on the carrier and defining with the smoothly arched upright a smoothly arched retaining gap for holding a sheet member firmly in a vertical position. According to another aspect of the present invention, the dome-like cover member holds a fluid and a floating ornament on the fluid. After insertion of a sheet member into the retaining gap in between the dome-like cover member and the smoothly arched upright, the inserted sheet member does not block the user's sight from viewing the floating ornament on the fluid inside the dome-like cover member.

DETAILED DESCRIPTION OF THE INVENTION

Figure 1:
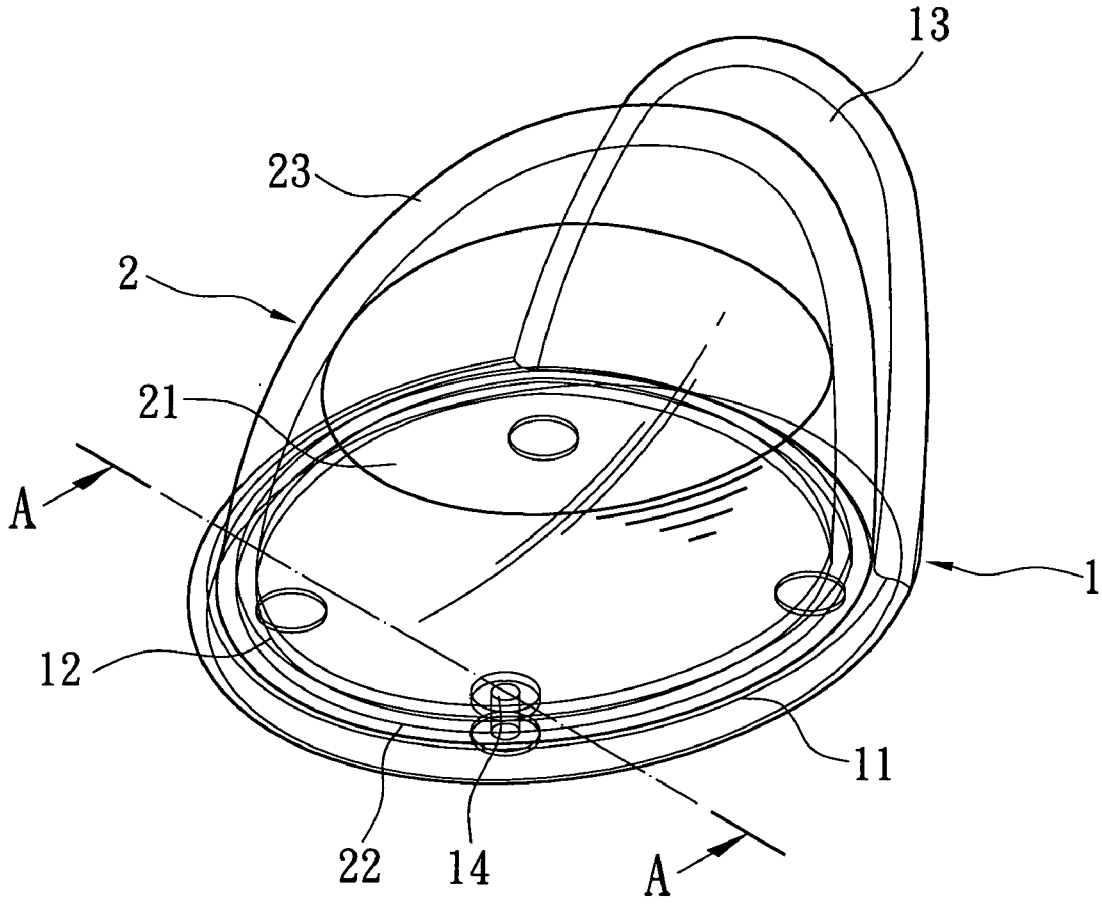
FIG. 1 is a perspective assembly view of a sheet member holder according to the present invention.
Figure 2:
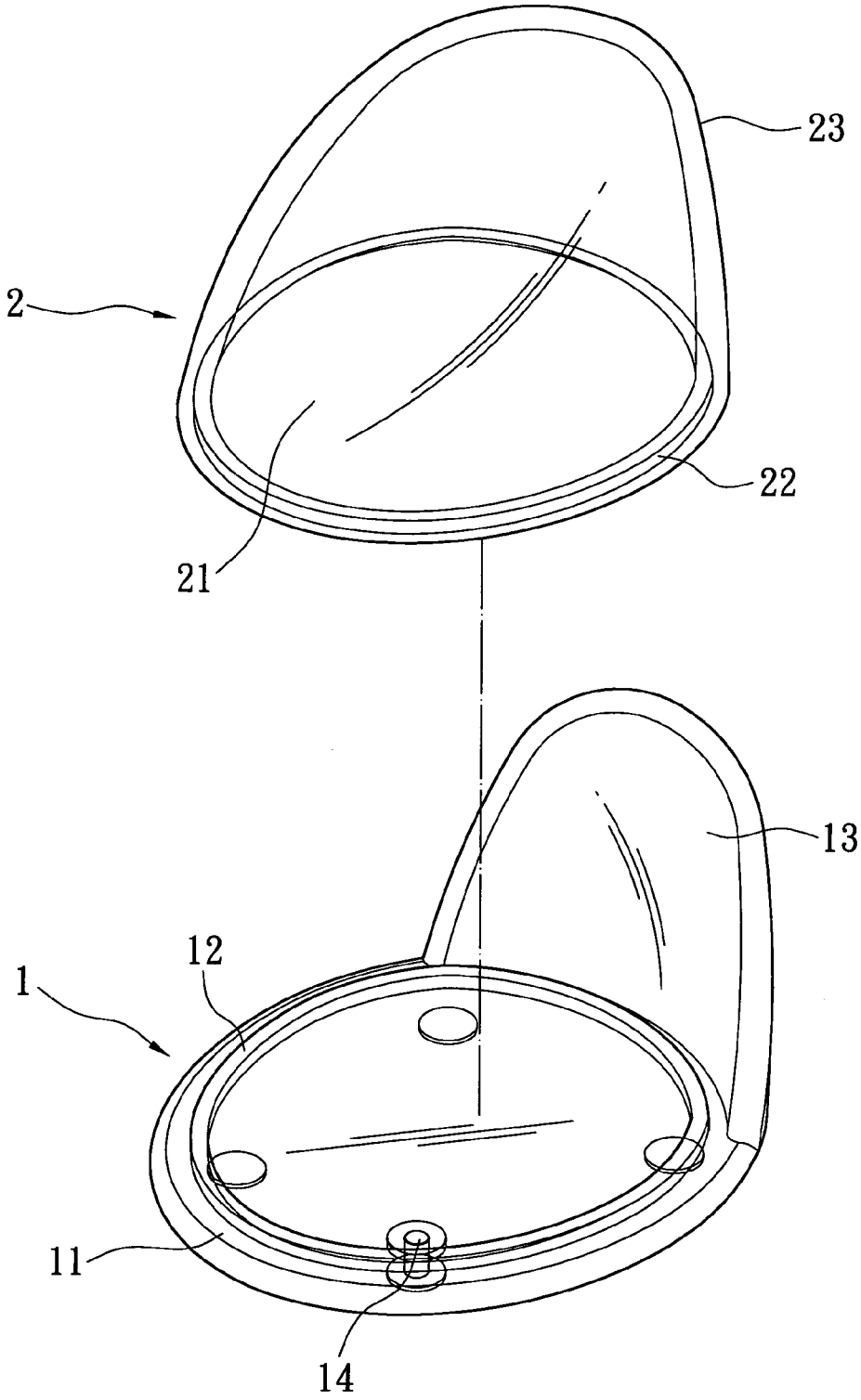
FIG. 2 is an exploded view of the sheet member holder according to the present invention.

Referring to FIGS. 1 and 2, a sheet member holder in accordance with the present invention is shown comprised of a holder base 1, and a cover member 2. The cover member 2 is a hollow member mounted in the holder base 1 to hold a sheet member or the like in a vertical position. Further, the cover member 2 can be filled with a fluid and floating ornaments (not shown). Therefore, the sheet member holder can hold a sign or page in a vertical position while serving as an ornamental display toy.

The holder case 1 comprises a carrier 11, an endless coupling flange 12 upwardly protruded from the top surface of the carrier 11 for holding the cover member 2, a smoothly arched upright 13 upwardly extended from the top surface of the carrier 11 at one side, and a through hole 14 extended through the top and bottom sides of the carrier 11 within the area surrounded by the endless coupling flange 12. After installation of the cover member 2 in the holder base 1, water can be filled through the through hole 14 into the space surrounded by the endless coupling flange 12 between the holder base 1 and the cover member 2.

The cover member 2 comprises a dome-like cover shell 23, a holding chamber 21 defined in the dome-like cover shell 23, and an endless coupling groove 22 formed in the bottom side of the dome-like cover shell 23 around the bottom open side of the holding chamber 21. After coupling of the endless coupling groove 22 of the cover member 2 to the endless coupling flange 12 of the holder base 1, a retaining gap 3 is defined between the dome-like cover shell 23 and the smoothly arched upright 13 for holding a sheet member in a vertical position. Because the retaining gap 3 has a smoothly arched cross section, the sheet member been held in the retaining gap 3 is maintained in a curved status, which enhances the stiffness of the sheet member in the upright position.

Figure 3:
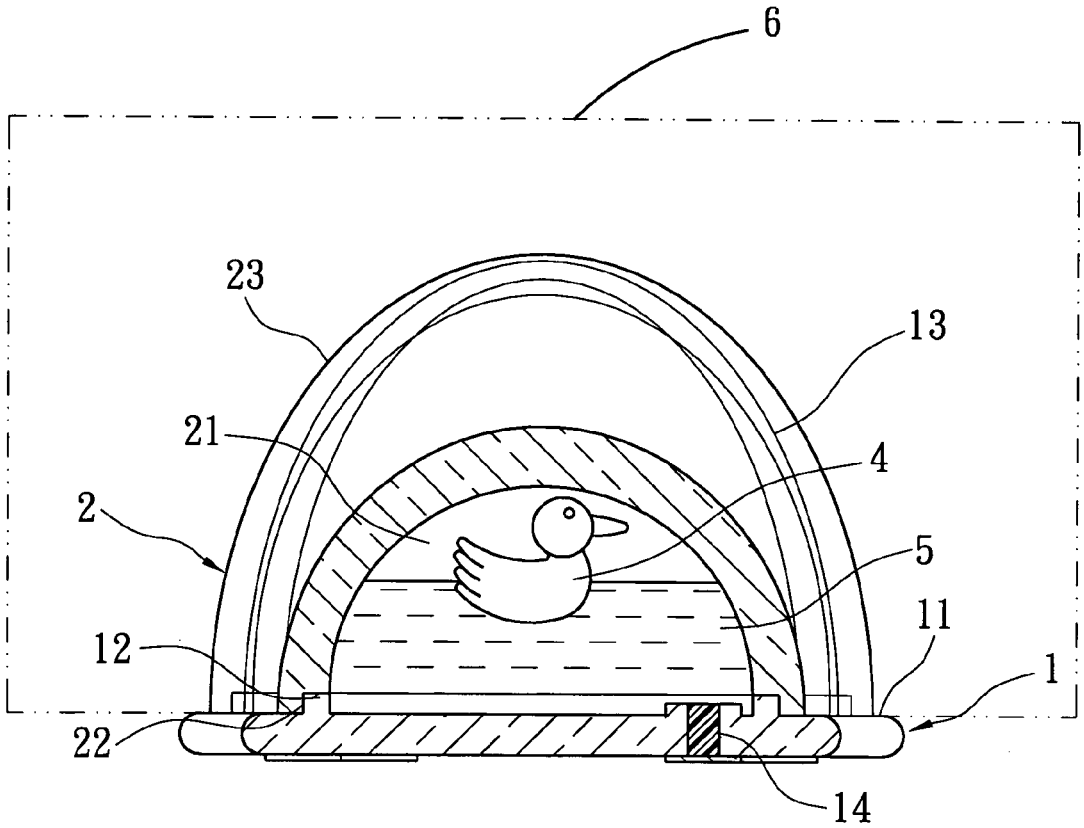
FIG. 3 is a sectional view taken along line A—A of FIG. 1.

FIG. 3 is a sectional view taken along line A—A of FIG. 1. A floating ornament 4 is put in the holding chamber 21 of the cover member 2 before fastening the cover member 2 to the holder base 1. After connection of the cover member 2 to the holder base 1, a fluid 5 is filled into the holding chamber 21 through the through hole 14. After filling of a certain amount of the fluid 5 into the holding chamber 21, the through hole 14 is sealed. When set the sheet member holder on a flat surface, for example, the tabletop, the floating ornament 4 is floating on the fluid 5, causing a sense of beauty.

When holding a sheet member 6 in a vertical position in the retaining gap 3 between the dome-like cover shell 23 of the cover member 2 and the smoothly arched upright 13 of the holder base 1, the sheet member 6 does not block the user's sight from viewing the internal scene of the cover member 2, i.e., the user can see the floating of the floating ornament 4 on the fluid 5.

Figure 4:
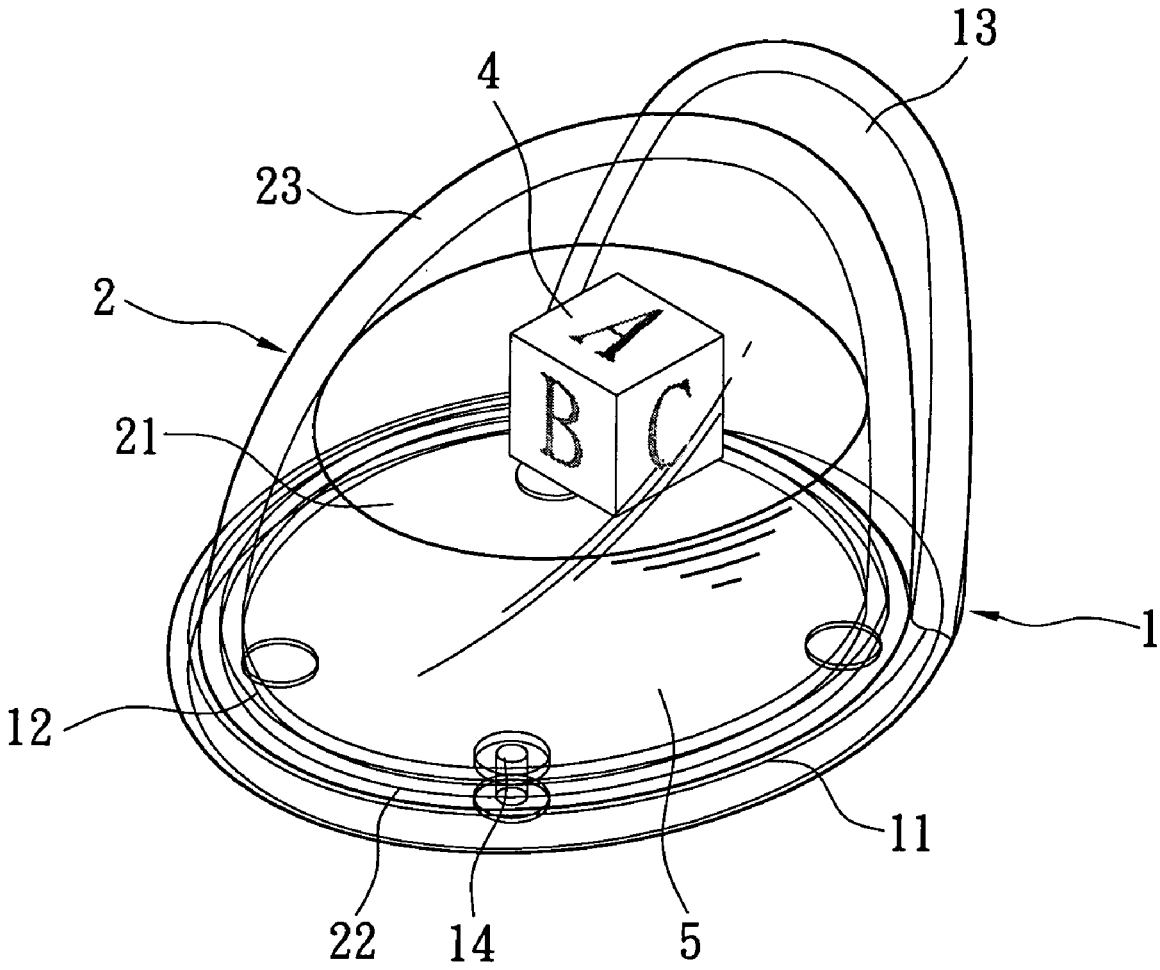
FIG. 4 shows an alternate form of the present invention.

FIG. 4 shows an alternate form of the present invention. According to this embodiment, the fluid 5 filled in the holding chamber 21 of the cover member 2 includes two liquids of different specific gravity; the floating ornament 4 is a three-dimensional block member marked with any of a variety of signs (company's logo, carton figure, etc.). Furthermore, the outside wall of the cover member 2 may be printed with a printing or sign for advertising purpose.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A sheet member holder comprising:

a holder base, said holder base comprising a carrier, a smoothly arched upright upwardly extended from said carrier at one side, and a through hole extended through top and bottom sides of said carrier;

a cover member covering said carrier, said cover member comprising a dome-like cover shell, which defines with said smoothly arched upright of said holder base a retaining gap for holding a sheet member in a vertical position, and a holding chamber defined within said dome-like cover shell in communication with said through hole of said holder base; and a fluid filled through said through hole into said holding chamber and retained in said holding chamber after sealing of said through hole; and floating ornamental means floating on said fluid.

2. The sheet member holder as claimed in claim 1, wherein said carrier comprises a coupling flange protruded from a top surface thereof for holding said cover member.

3. The sheet member holder as claimed in claim 2, wherein said cover member comprises a coupling groove formed in a bottom side of said dome-like cover shell around a bottom opening of said holding chamber for coupling to said coupling flange of said carrier.

4. The sheet member holder as claimed in claim 1, wherein said fluid is formed of one liquid having a predetermined specific gravity.

5. The sheet member holder as claimed in claim 1, wherein said fluid is formed of different liquids having different specific gravity.

6. The sheet member holder as claimed in claim 1, wherein said floating ornamental means is a three-dimensional ornamental block having a design thereon.

7. The sheet member holder as claimed in claim 6, wherein said design is a company's logo.

* * * * *